US006688043B1

(12) United States Patent
Feder et al.

(10) Patent No.: US 6,688,043 B1
(45) Date of Patent: Feb. 10, 2004

(54) DEVICE AND METHOD FOR SECURING A COMPONENT TO A SUPPORT PART IN A VEHICLE

(75) Inventors: Roland Feder, Weitramsdorf (DE); Uwe Waltz, Bamberg (DE); Horst Weber, Wirsberg (DE); Gerhard Hofmann, Untersiemau (DE)

(73) Assignee: Brose Fahrzeugteile GmbH & Co. KG, Coburg (DE)

( * ) Notice: Subject to any disclaimer, the term of this patent is extended or adjusted under 35 U.S.C. 154(b) by 0 days.

(21) Appl. No.: 09/423,127

(22) PCT Filed: Apr. 25, 1998

(86) PCT No.: PCT/DE98/01183

§ 371 (c)(1),
(2), (4) Date: Feb. 24, 2000

(87) PCT Pub. No.: WO98/50658

PCT Pub. Date: Nov. 12, 1998

(30) Foreign Application Priority Data

May 6, 1997 (DE) ..... 197 20 867

(51) Int. Cl.[7] ..... E05F 11/38
(52) U.S. Cl. ..... 49/352; 49/502
(58) Field of Search ..... 49/348, 349, 352, 49/424, 459, 506, 502; 29/509, 512, 421.1; 72/379.2, 206

(56) References Cited

U.S. PATENT DOCUMENTS

| | | | | | |
|---|---|---|---|---|---|
| 2,321,755 | A | * | 6/1943 | Kost | 52/592.3 |
| 3,670,405 | A | * | 6/1972 | Dochterman | 29/596 |
| 4,109,417 | A | * | 8/1978 | Fogarollo | 49/352 |
| 4,168,595 | A | * | 9/1979 | Pickles et al. | 49/352 |
| 4,483,100 | A | * | 11/1984 | Blankenburg et al. | 49/352 |
| 4,502,247 | A | * | 3/1985 | Kobayashi et al. | 49/352 |
| 4,584,753 | A | | 4/1986 | Eckold et al. | |
| 4,658,302 | A | | 4/1987 | Sakamoto | |
| 4,658,502 | A | | 4/1987 | Eckold et al. | |
| 4,663,886 | A | * | 5/1987 | Nakamura et al. | 49/360 |
| 4,694,610 | A | | 9/1987 | Hornivius | |
| 4,700,508 | A | * | 10/1987 | Kollner et al. | 49/352 |
| 4,759,653 | A | * | 7/1988 | Maekawa et al. | 403/24 |
| 4,819,380 | A | * | 4/1989 | Trebbi | 49/374 |
| 4,843,204 | A | * | 6/1989 | Ueno | 219/756 |
| 5,120,151 | A | | 6/1992 | Farris et al. | |
| 5,273,385 | A | * | 12/1993 | Rose et al. | 411/501 |
| 5,333,411 | A | | 8/1994 | Tschirschwitz et al. | |
| 5,826,376 | A | * | 10/1998 | Yamamoto et al. | 49/350 |

FOREIGN PATENT DOCUMENTS

| | | | | |
|---|---|---|---|---|
| DE | 41 31 098 A1 | | 3/1993 | |
| DE | 44 17 279 A1 | | 11/1995 | |
| DE | 195 28 467 A1 | | 2/1997 | |
| EP | 0 155 618 A2 | | 9/1985 | |
| EP | 0 155 619 A2 | | 9/1985 | |
| EP | 478501 | * | 4/1992 | 72/379.2 |
| EP | 0 584 442 A1 | | 3/1994 | |
| FR | 2758850 | * | 1/1997 | 49/352 |

* cited by examiner

*Primary Examiner*—Gregory J. Strimbu
(74) *Attorney, Agent, or Firm*—Christie, Parker & Hale, LLP

(57) ABSTRACT

A device for connecting component parts, such as entrainment members, to a support element of a motor vehicle door, wherein the support element has at least one protrusion therein for the positive-locking hold of the entrainment members. In one embodiment two protrusions are provided forming guide rails for entrainment members of a window pane of a cable or Bowden cable window lifter. The two protrusions are imprinted in a support plate whereby the guide rails and the support plate are preferably a one-piece structural unit of a motor vehicle door.

18 Claims, 6 Drawing Sheets

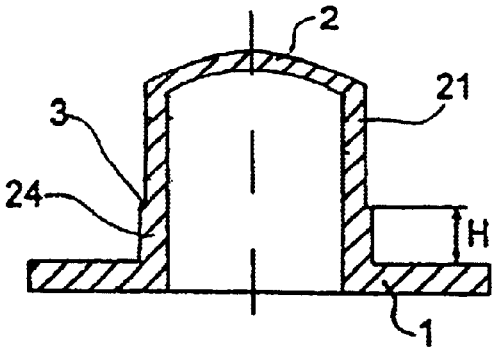
Fig. 1A
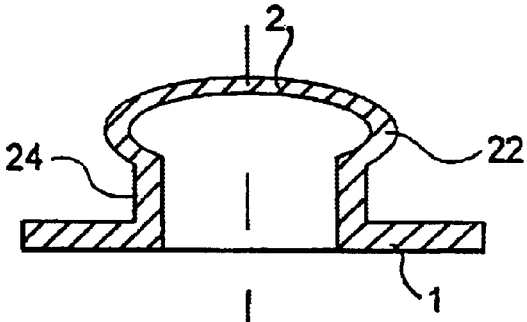
Fig. 1B
Fig. 1C
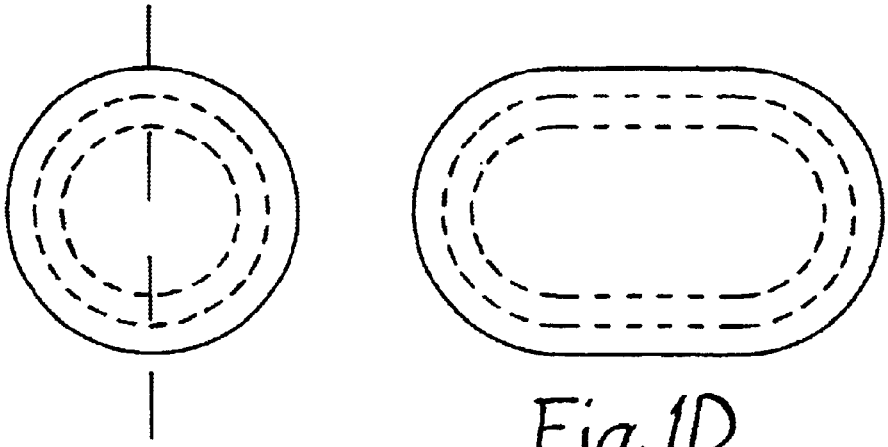
Fig. 1D

DEVICE AND METHOD FOR SECURING A COMPONENT TO A SUPPORT PART IN A VEHICLE

FIELD OF THE INVENTION

The invention relates to a device and method for connecting a component part provided with an assembly or connecting opening to a support element of a motor vehicle, more particularly to a support plate of a vehicle door module.

BACKGROUND OF THE INVENTION

In order to fix component parts on a support element such as, for example, a support plate or a door module it is standard to use connecting elements such as screws, rivets, clips and the like with which the relevant component part is fixed on the support element. This type of fixing requires however additional connecting elements, causes, for example, when using blind rivets additional waste and requires additional assembly time and corresponding assembly costs for aligning, adjusting and attaching the component part.

When manufacturing and assembling movable devices for motor vehicles it is often necessary to connect a component part, which has a tubular section (e.g. a stepped bolt) and which is provided, for example, for rotary mounting a gearbox element, cable roller or the like, to a further component part (e.g. a holding angle).

To this end it is known from DE OS 41 31 098 to use a multi-stepped axle bolt which is fixed by means of rivet elements on a holding angle, for the rotatable bearing of the guide pulley of a cable window lifter. A bore provided in the axle bolt serves to fix the entire structural group (axle bolt, guide pulley, holding angle and where applicable further components ) on a vehicle plate.

The known method for fixing an axle bolt on a holding angle has the drawback that additional rivets or other fixing elements are required and an additional work step-is necessary to attach and where applicable deform the fixing element.

Furthermore when manufacturing and fitting movable devices for motor vehicles it is often necessary to connect two sheet metal parts together.

So-called through seaming techniques are known to connect sheet metal parts whereby a positive connection is produced between the two sheet metal parts by re-shaping local plastics materials whereby the use of additional connecting means (e.g. rivets) becomes unnecessary. These through seaming techniques however have the drawback that they require an expensive apparatus to pre-fit the sheet metal parts which are to be connected so that these can be aligned relative to each other so that they adjoin one another along the desired contact bearing faces.

A further drawback exists in that it is difficult to check the quality of the connections produced since access to carry out a visible check on the areas of the two sheet metal parts which positively engage in each other is difficult.

From DE 44 17 279 A1 a method is known for positively connecting two component parts of movable devices for motor vehicles of which one has a tubular section which is provided for the rotatable or rotationally fixed bearing of a further part. The tubular section of the first component part is guided in an opening of the second component part provided for this purpose and exerts on the tubular section a force in the axial direction through which the tubular section becomes compressed in a partial area so that the compressed area of the tubular section produces a positive locking connection with the second component part. The cable pulley of a window lifter can be mounted for example on the non-deformed axial partial section of the first component part.

The known method allows a simple quick and easy production of a direct durable connection between two component parts wherein, however, one of the two component parts is permanently deformed.

When fitting component parts on a support plate or door module of a motor vehicle care is to be taken that the moisture-tight separation between the wet cell and dry cell of a door is not broken since moisture-sensitive component parts in the dry cell of the vehicle door could be damaged or suffer impaired function.

Furthermore constructing structural groups or incorporating them in other systems with an increasing number of individual elements basically entails further disadvantages. These not only include increased expense for handling but also give rise to faults in fitting and assembling. A large number of parts often requires additional measures for compensating tolerances, for example through oblong hole guides, or a very high precision during manufacture, which is again very cost-intensive.

Furthermore it is desirable with the minimum weight, particularly of a door module, to obtain maximum stability, preferably maximum side impact stability. These contradicting demands can only be met with special technical measures such as reinforcement impressions which however again severely restrict the possibilities when fitting the component parts which are to be connected to a support element.

SUMMARY OF THE INVENTION

The object of the present invention is therefore to provide a device and method of the kind mentioned above wherein no additional connecting elements or separate distance-bridging means and no measures for compensating tolerance are required, which cause less assembly time and costs, where applicable guarantee a water and pressure tight connection on the support element and which allow a reduction in the work steps and further ensure a saving in weight and an increase in the stability, more particularly the side impact stability.

The solution according to the invention allows component parts to be fixed or attached and guided on a support element, more particularly a vehicle door, without additional connection elements or separate distance-bridging means as well as no measures for compensating tolerances, guarantees a minimum assembly time and minimum assembly costs and ensures in various different embodiments that the closed contour of the support plate or door module is not broken by the guide or fastening of the component parts so that with these embodiments no additional seals are required between the support element and the guided or fastened component part.

Furthermore the solution according to the invention allows a reduction in the work steps and a reduction in the weight while at the same time increasing the stability, more particularly the side impact stability. Thus when using thinner sheet metal plates an improved mechanical load bearing capacity can be achieved, more particularly a strength which can be adapted to concrete conditions.

An advantageous development of the solution according to the invention is characterized in that the dished shape of the support element is deep drawn or imprinted.

Preferably the box or channel-like dish shape is provided with a reduction in the cross section for an ideal reshaping area or an ideal reshaping point which divides the dish shape into a deformation area and a support or guide area. The deformation area is deformed additionally before or after attaching the component part.

Furthermore the deformation area can be compressed to form a lens-shaped head or a channel which is a box-shape in cross-section, opens like a duct and has semi-circular end sides. In order to form a plate-shaped head with a fold adjoining the guide or support area, the lens-shaped area or the box-section channel is further deformed.

By imprinting guide rails for the entrainment member of a window pane of a cable or Bowden window lifter into the support element (support plate), and thus by integrating the guide rails into the support element, a one-piece arrangement is achieved instead of the otherwise three-part arrangement with left and right guide rails as well as separate support plate for holding the guide rails and drive means of a cable or Bowden window lifter.

This embodiment furthermore allows narrower tolerances to be observed by a one-step manufacture with defined distances or defined association between the left and right guide rails.

At least one guide rail and the support element can be designed as an integral structural unit which forms together with further function elements of a motor vehicle door, such as a door lock, an electric locking, a cable tree, a window lifter drive and the like, and one vehicle door module.

The guide rails can thereby selectively form the edge area of the support element or can be worked into the surface of the support element.

Furthermore the ends of the guide rails can have breaks in the material to hold the cable pulley member or to mount the cable pulleys, more particularly nozzle openings and/or dish-shaped impressions.

A further advantageous design of the solution according to the invention is characterized in that the support element has several interconnected imprinted or deep-drawn areas which preferably serve to hold, guide and /or cover component parts and to increase the stiffness of the support element.

Through this design of the solution according to the invention an open system is possible by integrating reinforcement imprints which are not possible in the case of a three-part design of a cable or Bowden window lifter having a left and right guide rail as well as a support plate for holding the guide rails and the drive device. A clear reduction in weight by using thinner materials while simultaneously increasing the side impact stiffness is now obtained.

BRIEF DESCRIPTION OF THE DRAWINGS

Various embodiments and examples of the method according to the invention and the device according to the invention are shown in the drawings in which:

FIGS. 1A–1B show cross-sectional views in each of two stages of producing a dished impression in a support plate with a moulded deformation area, FIG. 1C shows a plan view of FIG. 1B, and FIG. 1D shows an alternative embodiment in plan view.

DETAILED DESCRIPTION

Figure 2A:
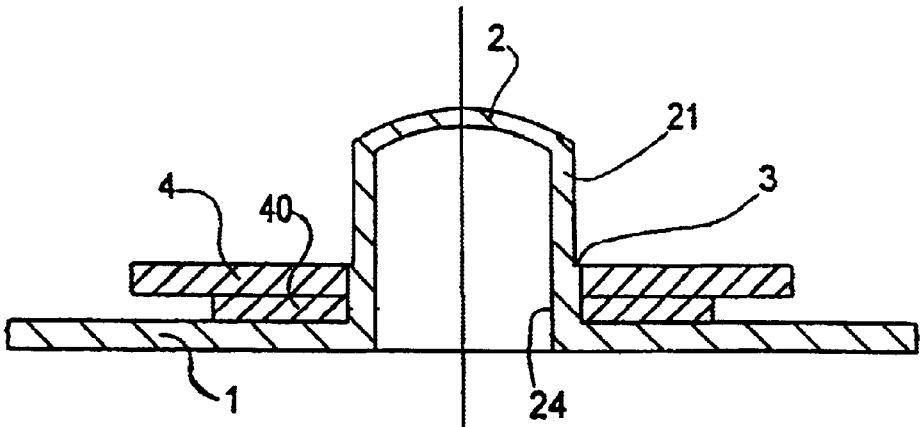
FIGS. 2A–2C show the fixing of a structural element on a support plate provided with a dished impression.

FIGS. 1A to 1C show in cross section and plan view two stages when producing a positive locking connection for structural elements on a support plate.

In a first production stage according to FIG. 1A, the support plate 1 is imprinted or deep drawn so that a dish-shaped impression 2 is provided on which a component part provided with a bore or the like can be axially fitted. By making an ideal re-shaping area 3 in the form of a reduction in the cross-section or the like, the dish-shaped impression 2 is divided into a deformation area 21 and a guide or support area 24.

The guide or support area 24 defines the support heigh H which corresponds to the thickness or depth of the socket bore of the component part which is to be fixed.

FIGS. 1B and 1C show the further deformation of the deformation area 21, which by way of example is cylindrical in this embodiment, by applying a compressive force onto the dish-shaped impression 2 so that a lens or mushroom shaped head 22 is formed on which a component part having an elastic or snap-fitting socket opening can be fitted after deformation of the support plate 1 or in the case of a component part fitted on prior to deformation according to FIG. 1B can be secured in its position.

Figure 2B:
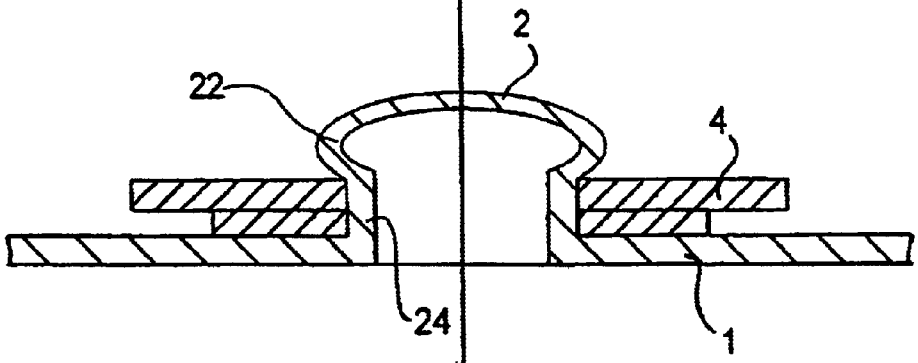
Figure 2C:
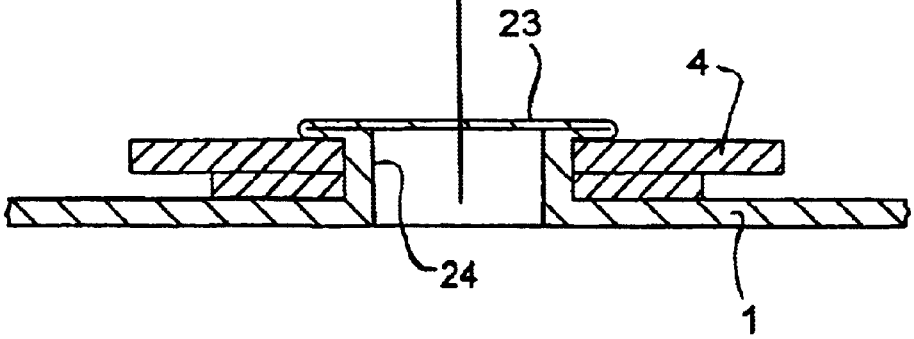

FIGS. 2A to 2C show the connection of a component part 4 with a support plate 1 in the various phases of producing a positive locking connection.

FIG. 2A shows the support plate 1 which is provided with a dished impression 2 and whose deformation area 21 is formed cylindrical with a curved cover face. By providing an ideal re-shaping area 3, the dished impression 2 is divided into the deformation area 21 and the guide or support area 24. In this deformation stage of the support plate 1, a washer 40 and the component part 4 provided with a corresponding bore are fitted onto the deformation area 21 of the support plate 1 so that the side of the component part 4 remote from the support plate 1 is level with the reshaping area 3.

By deforming the deformation area 21 of the dished impression 2 according to FIG. 2B a lens or mushroom shaped head 22 is produced out of the dished impression 2 which in this form is already sufficient to secure the component part 4 in position. Through further deformation of the head 22 the dished impression 2 is brought into flush alignment with the top of the component part 4 so that a cylindrical guide channel 24 and a circular disc shaped positioning and securing surface (a plate-shaped head) 23 are obtained.

The dished impressions according to FIGS. 1 and 2 serve to hold and secure in position various types of component parts such as assemblies, guide elements, lock supports, speakers or the like which are preferably mounted in the dry area of a motor vehicle door whereby the support plate or door module 1 produces the separation between the wet and dry cells of the vehicle door.

In the same way elongated (channel-like) socket profiles can also be formed in a support plate.

Figure 3A:
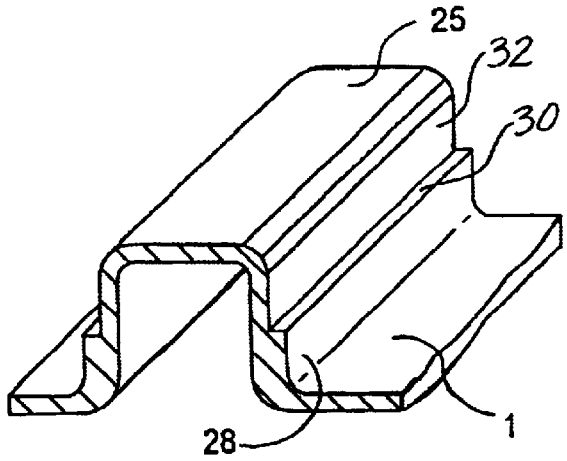
FIGS. 3A–3C show diagrammatic perspective illustrations of a channel-shaped dished impression by deforming a support plate.
Figure 3B:
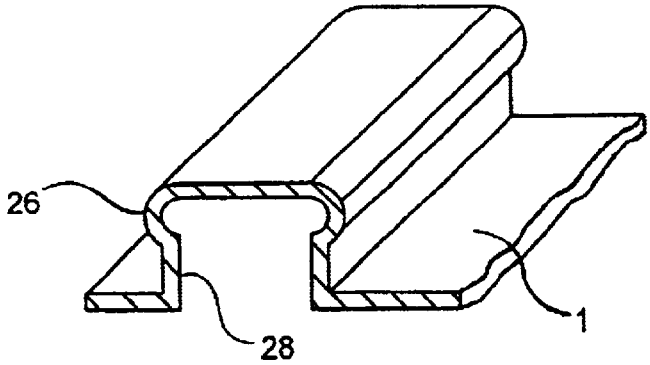
Figure 3C:
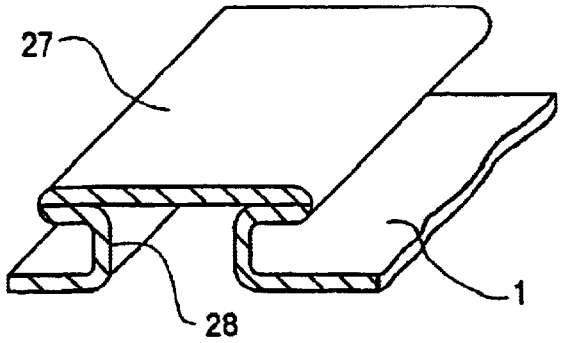

FIGS. 3A to 3C show in a diagrammatic perspective view the various production stages of a fastening and connecting device of this kind.

According to FIG. 3A a dished impression 25 has been created by impression or deep-drawing in the support plate 1 which corresponds to the dished impression according to FIGS. 1 and 2. By applying an ideal re-shaping area 30 at a distance from the surface of the support plate 1 which corresponds to the support height or material thickness of the component part which is to be fixed and guided it is possible to determine the further deformation area 32 of the curvature.

FIG. 3B shows the fastening and securing area 26 deformed above the ideal re-shaping area as well as the support or guide area 28 running underneath the ideal re-shaping area. In a following production stage according to FIG. 3C the guide (fastening) and securing area (a channel or web) 26 can be further flattened and form a surface (web) 27 running parallel to the support plate 1. A channel-shaped indentation wherein the surface 27 forms part of a T-shaped securing and guide face 27 is thereby provided in the support plate 1.

The deformation area thus formed in the support plate 1 of a motor vehicle door serves to fasten and guide component parts of, for example, a door module.

Figure 4:
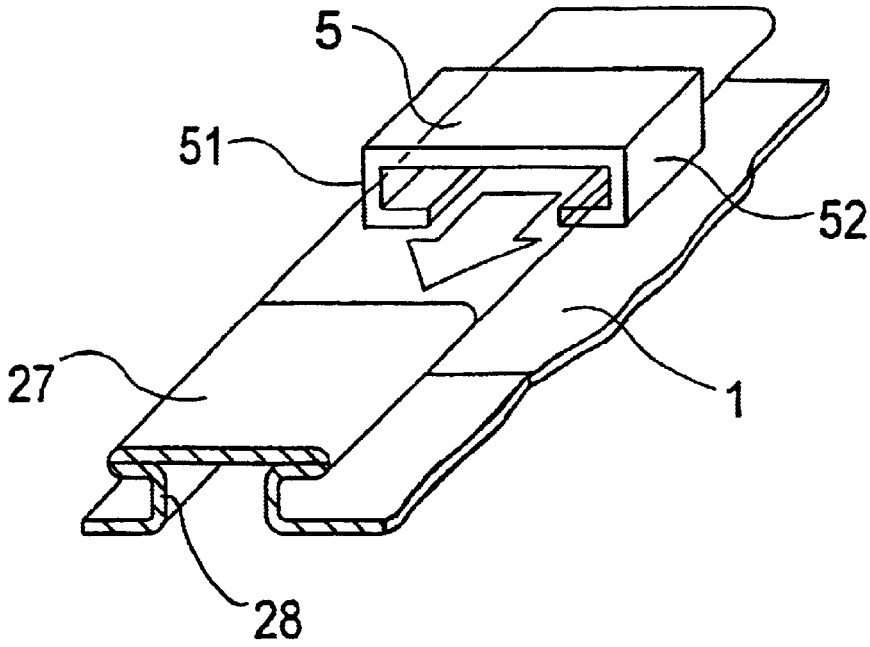
FIG. 4 shows the attachment of an entrainment member of a cable window lifter on a support plate provided with a T-shaped deformation.
Figure 5:
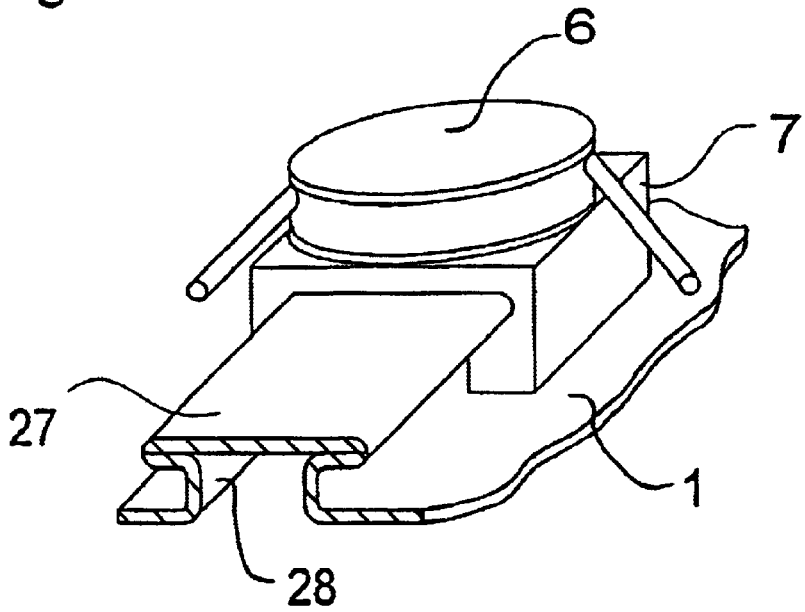
FIG. 5 shows the connection of a cable pulley with a deformed support plate.
Figure 6:
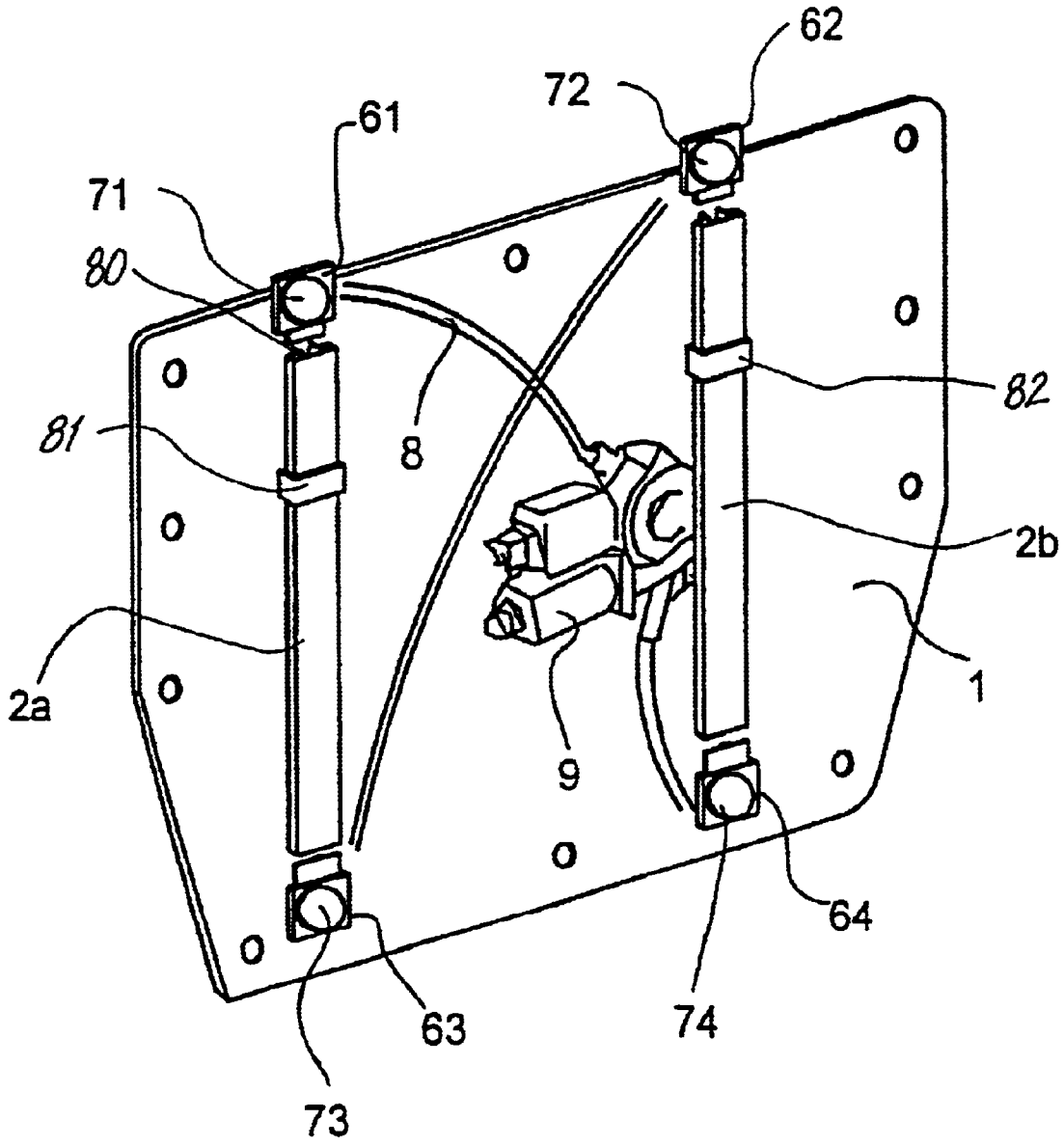
FIG. 6 shows a diagrammatic perspective view of a door module having a cable window lifter whose fastening is shaped out of the support plate of the door module.

FIGS. 4 to 6 show various different examples of use in a diagrammatic perspective view.

FIG. 4 shows the fastening profile produced according to FIG. 3 in the support plate 1 of a door module on which an entrainment member 5 is fitted for a cable window lifter whose guide channel is adapted to the deformed dished impression 27 of the support plate 1. The support height 28 of the deformed dished impression forms a type of rail guide for the entrainment member 5 and is enclosed by the side guide elements 51 and 52 of the entrainment member 5 whose guide surface corresponds to a slit box section.

FIG. 5 shows the fastening of a cable pulley 6 connected to a support element 7 on the deformed dished impression 27 of a support plate 1 whereby the support element 7 is fitted onto the deformed dished impression 27 of the support plate 1.

FIG. 6 shows a support plate 1 with guide rails of a cable window lifter formed on its surface and thus on its inner area by dished impression or deep-drawing the support plate 1 and which serves at the same time to hold cable pulleys mounted on a support element.

Before fitting the support elements 71, 72, 73, 74 having the cable pulleys 61, 62, 63, 64 fixed thereon, entrainment members 81, 82 are fitted onto the guide rails 2*a* and 2*b* which are formed by dished impression, for example, according to FIG. 3. The ends of the guide rails have breaks 80 to mount the cable pulleys. The support elements 71, 72, 73, 74 are then fitted onto the ends of the imprinted rails 2*a*, 2*b* and the cable 8 is placed round the cable pulleys 61, 62, 63, 64 and connected to the entrainment members 81, 82.

The drive motor 9 can, in this embodiment according to FIG. 6, be connected to the support plate 1 in the manner illustrated in FIGS. 1 and 2.

The support plate 1 serves in the embodiment according to FIG. 6 as a separation between the wet cell and dry cell of a vehicle door and thus provides a good seal between the wet and dry cells. Owing to the closed contour formed by deep drawing or dished impression, a watertight separation is present so that no additional seal is required between the support plate 1 and the fastening areas or the component parts to be fixed, such as guide rails, guide pulleys or drive motor.

This and the following embodiment are particularly suitable for a motor vehicle door module if the one-piece structural unit of support plate and guide rails is equipped with further function elements of a vehicle door, such as a door lock, an electric locking, a cable tree, a window lifter drive and the like.

Figure 7:
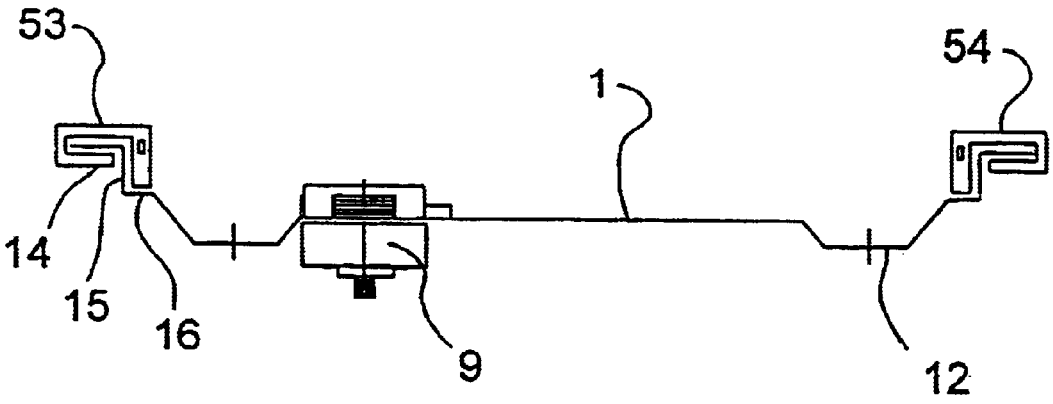
FIG. 7 is a cross-sectional view along line 7—7 of FIG. 8.
Figure 8:
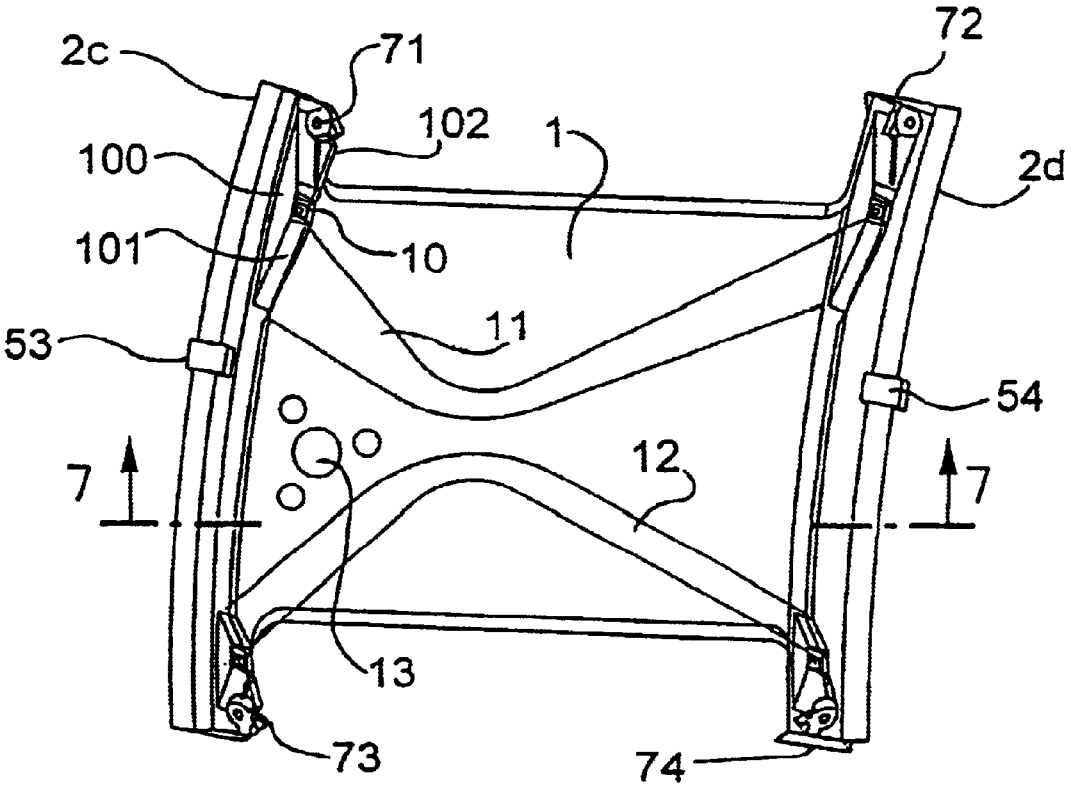
FIG. 8 is a diagrammatic perspective view of a support plate with integrated reinforcement impressions and guide rails for a single and double strand cable or Bowden window lifter.

FIG. 8 shows a diagrammatic perspective view of an imprinted, more particularly deep drawn, support plate with imprinted guide rails for entrainment members of a window pane of a cable or Bowden window lifter and FIG. 7 shows a sectional view along the line 7—7 of FIG. 8.

The imprinted support plate 1 consists of a deep-drawn sheet metal profiled section having several profiled sections at angles to each other. In the edge area, i.e. on the outer side edges of the support plate 1 there are guide rails 2*c*, 2*d* for the entrainment members 53, 54 for a window pane of a cable or Bowden cable window lifter which consist of guide faces 14, 15, 16 which are angled at right angles to each other. The entrainment members 53, 54 slide on these guide faces 14, 15, 16 of the guide rails 2*c*, 2*d* up and down depending on the pull direction of the window-lifter cable or Bowden cable (not shown). The window lifter cable or Bowden cable is guided over cable pulleys 71, 72, 73, 74 whereby cable mountings arranged on the cable pulleys 71, 72, 73, 74 serve to attach the Bowden cable sleeves. A motor gear unit 9 provided at a corresponding indentation with apertures 13 on the support plate 1 serves to drive the cable or Bowden cable window lifter.

The largest deep drawn areas are located in the area of the fixing point 10 of the support plate 1. They bridge the distance between the guide faces 14, 15, 16 of the guide rails 2*c*, 2*d* for the entrainment members 53, 54 of the window pane and the fixing of the support plate 1, and are substantially defined by a depth-setting surface 100, a surface 101 and a reinforcement setting 102.

The depth setting surface 100 has substantially the shape of an isosceles triangle whose obtuse angle adjoins the fixing area 10. The arm edges of the isosceles triangle form a connection between the surface 101 and the depth setting surface 100 while on the other side the base edge of the depth setting surface 100 marks the transition to the narrow guide face 16 for the entrainment member 53, 54.

The drawn-in material areas for the fastening point 10 of the support plate 1 can be shaped differently depending on which distances are to be bridged.

Through the one-piece design with the guide rails integrated in the support plate and the defined distances of the two guide rails 2*c*, 2*d* resulting from this it is possible to observe very narrow tolerances with a one-step production. Furthermore reinforcement impressions (imprinted or deep-drawn areas) 11, 12 allow an open system as well as a weight reduction through the resulting stiffness achieved by the reinforcement impressions whereby thinner materials are used while at the same achieving high side impact strength.

The reinforcement impressions 11, 12 can also serve at the same time to hold and enclose Bowden cable sleeves or with a corresponding design to enclose the cable of a cable window lifter when corresponding guides or openings are provided for example to the motor gear unit 9 as well as to the guide pulleys 71, 72, 73, 74.

What is claimed is:

1. A vehicle door having a support assembly for a window pane of a cable window lifter, the support assembly comprising:

an entrainment member to support the window pane; and a support element lying generally in a plane, the support element separating a wet cell from a dry cell of the vehicle door;

wherein the support element has at least one protrusion that forms an elongated guide rail and is a homogeneous part of the support element;

wherein the protrusion protrudes from one side of the support element in a direction generally perpendicular to the plane of the support element and toward the window pave to define a corresponding indentation on an opposite side of the support element;

wherein the entrainment member is in sliding engagement with the guide rail;

wherein the support element extends beyond two sides of the entrainment member in the plane of the support element in a direction perpendicular to a longitudinal axis of the guide rail.

2. The vehicle door according to claim 1 wherein the guide rail has an area of reduced cross-section and, near the area of reduced cross-section a re-shaping area.

3. The vehicle door according to claim 1 wherein the guide rail has at least one of a deformation area and a guide area.

4. The vehicle door according to claim 3 wherein the guide rail and the support element are formed together with a functional element of the vehicle door.

5. The vehicle door according to claim 4 wherein the functional element is at least one of a window lifter drive and a vehicle door module.

6. The vehicle door according to claim 3 wherein the deformation area comprises a web with rounded end sides.

7. The vehicle door according to claim 3 to wherein the entrainment member is a structural element connected to at least one of the deformation, and guide areas, wherein the structural element has an open channel configuration.

8. The vehicle door according to claim 3 wherein an end of the guide rail has a break to hold a cable guide member.

9. The vehicle door according to claim 1 wherein the guide rail is generally T-shaped.

10. The vehicle door according to claim 1, wherein the support element supports a window lifter drive.

11. A method of connecting a component part for a cable window lifter to an inner door support element of a motor vehicle door, the method comprising:

providing the inner door support element lying generally in a plane;

imprinting at least one protrusion out from a portion of the inner door support element to define at least one of a deformation area, and a guide area to form an elongated guide rail that is a homogeneous part of the support element wherein the protrusion protrudes from one side of the support element in a direction generally perpendicular to the plane of the support element and toward a window pane of the vehicle door to define a corresponding indentation on an opposite side of the support element;

attaching the component part in keyed engagement with the guide rail such that the support element extends beyond two sides of the component part in the plane of the support element in a direction perpendicular to a longitudinal axis of the guide rail;

attaching the inner door support element to a vehicle door module to separate a wet cell from a dry cell of the vehicle door.

12. A method according to claim 11 wherein at least one of the deformation and guide area of the support element is deep drawn.

13. A method according to claim 11 or 12 wherein the protrusion has a dish shape, the method further comprising at least partially deforming the protrusion one of before and after fitting the component part thereto.

14. A method according to claim 13 wherein the protrusion has a channel shape, the method further comprising providing the protrusion with a reduced cross-section defining a re-shaping area which divides the channel shape into the deformation area and the guide area; and deforming the deformation area one of before and after assembly of the component part to the guide rail.

15. A method according to claim 14 further comprising compressing the deformation area to form a channel having a square shape cross-section.

16. A method according to claim 14 further comprising creating a plate-shape head with a fold adjoining the guide area.

17. A method according to claim 11 wherein the support element is a support plate of a motor vehicle door module and the component part is an entrainment member for the window pane.

18. A support assembly for a window pane of a cable window lifter for motor vehicles, the support assembly comprising:

at least two entrainment members to support the window pane; and a support element lying generally in a plane;

wherein the support element has at least two protrusions that form two guide rails and are a homogeneous part of the support element;

wherein the protrusions protrude from one side of the support element in a direction generally perpendicular to the plane of the support element and toward the window panes and each defines a corresponding indentation on an opposite side of the support element;

wherein the entrainment members are in sliding engagement with the guide rails, respectively.

* * * * *

UNITED STATES PATENT AND TRADEMARK OFFICE

CERTIFICATE OF CORRECTION

PATENT NO. : 6,688,043 B1
DATED : February 10, 2004
INVENTOR(S) : Feder et al.

It is certified that error appears in the above-identified patent and that said Letters Patent is hereby corrected as shown below:

Title page,
Item [73], Assignee, delete "Brose Fahrzeugteile GmbH & Co. KG, Coburg (DE)",
Insert -- Brose Fahrzeugteile GmbH & Co. KG, Coburg, Coburg (DE) --

Column 7,
Line 15, delete "pave", insert -- pane --
Line 54, after "deformation area", delete ","

Column 8,
Line 51, delete "panes", insert -- pane --

Signed and Sealed this

Second Day of August, 2005

JON W. DUDAS
*Director of the United States Patent and Trademark Office*